United States Patent [19]

Sakano et al.

[11] Patent Number: 4,459,966

[45] Date of Patent: Jul. 17, 1984

[54] APPARATUS FOR THE RETURN OF CRANKCASE VAPORS INTO A COMBUSTION CHAMBER OF AN INTERNAL COMBUSTION ENGINE

[75] Inventors: Kenji Sakano; Hiroo Sakanaka; Kazutoshi Okamoto, all of Sakaishi, Japan

[73] Assignee: Kubota Limited, Osaka, Japan

[21] Appl. No.: 307,162

[22] Filed: Sep. 30, 1981

[30] Foreign Application Priority Data

Aug. 4, 1981 [JP] Japan ..... 56-116641[U]

[51] Int. Cl.[3] ..... F02M 25/06

[52] U.S. Cl. ..... 123/573

[58] Field of Search ..... 123/572, 573, 41.86, 123/574; 55/320, 370, 385 B, 250

[56] References Cited

U.S. PATENT DOCUMENTS

| | | | |
|---|---|---|---|
| 2,208,673 | 7/1940 | Hopkins | 123/573 X |
| 3,257,995 | 6/1966 | Schnabel | 123/41.86 |
| 3,908,617 | 9/1975 | Partridge | 123/572 |
| 4,269,607 | 5/1981 | Walker | 123/573 X |

FOREIGN PATENT DOCUMENTS

| | | | |
|---|---|---|---|
| 1576405 | 4/1970 | Fed. Rep. of Germany | 123/572 |

*Primary Examiner*—William A. Cuchlinski, Jr.
*Attorney, Agent, or Firm*—Bacon & Thomas

[57] ABSTRACT

An apparatus for the return of crankcase vapors into a combustion chamber of an internal combustion engine, and for separating lubricating oil mist in the crankcase vapors. Some of the lubricating oil mist being removed primarily with a breather device and the residual oil mist being separated secondarily with an oil-bath type air cleaner, by directing the vapors into the air cleaner through a vapor passage.

4 Claims, 6 Drawing Figures

FIG.1
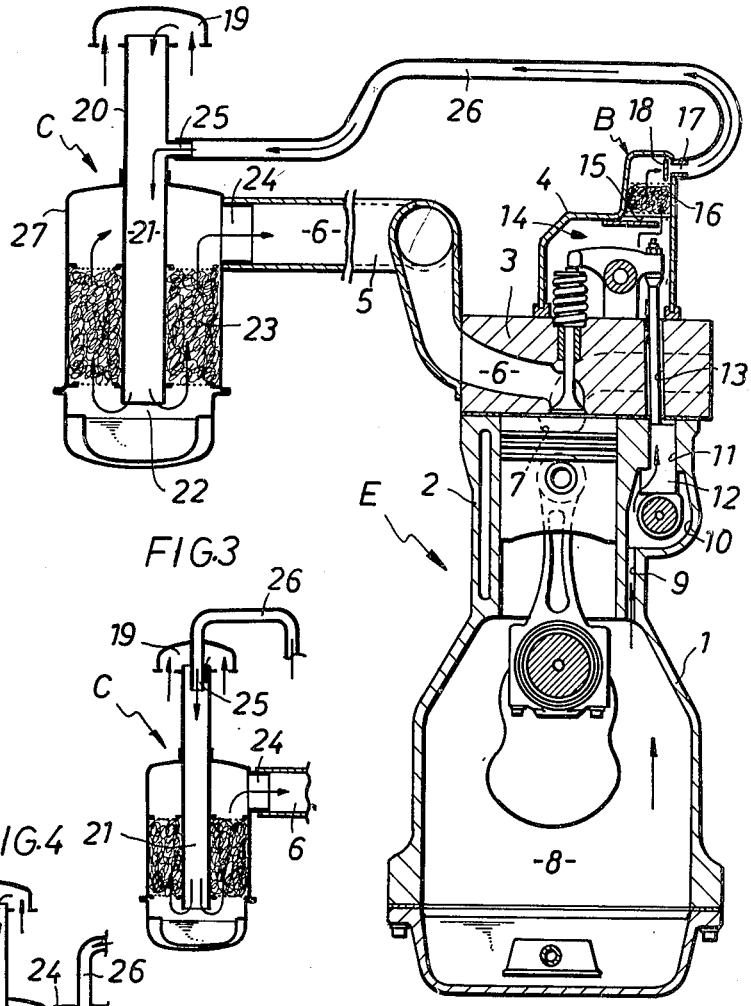
FIG.2
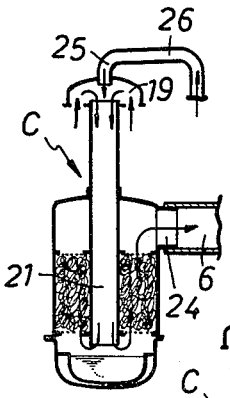
FIG.3
FIG.4
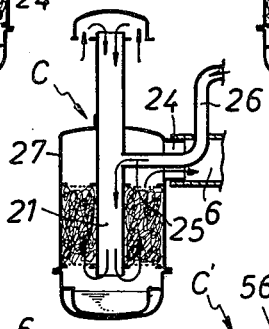
FIG.5
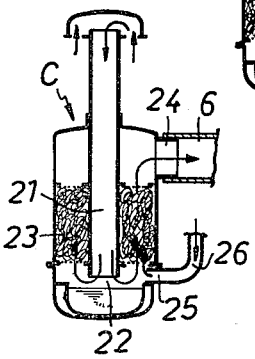
PRIOR ART
FIG.6
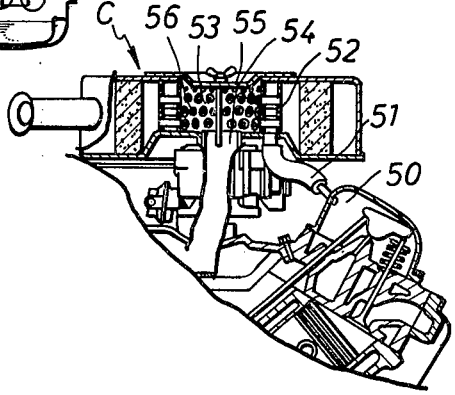

APPARATUS FOR THE RETURN OF CRANKCASE VAPORS INTO A COMBUSTION CHAMBER OF AN INTERNAL COMBUSTION ENGINE

BACKGROUND OF THE INVENTION

This invention relates to the field of technology involving apparatus for the return of crankcase vapors into a combustion chamber of an internal combustion engine.

DESCRIPTION OF THE PRIOR ART

As an example of the conventional art technology, the crankcase ventilating system of U.S. Pat. No. 3,533,385 is shown in FIG. 6.

In this ventilating system, the crankcase vapors in the crankcase flow into the rocker-arm chamber 50, then flow into an annular condenser 52 disposed in the secondary chamber of a dry air cleaner C' through connecting pipe 51.

In the condenser 52, the crankcase vapors are cooled with the intake air so as to condensate the oil mist in the vapors. The condensed oil mist flows back into the rocker-arm chamber 50, and the residual crankcase vapors rise upwardly and flow into the secondary chamber 56 of the air cleaner C' through small holes 55 perforated in the inner annular wall 53 of the condenser 52. The noncondensible fluids will continue to rise upwardly within the condenser chamber and mix with the carburetor inlet air for introduction into the combustion chambers of the internal combustion engine.

However, the above ventilating system produces the following problems:

(1) The intake quantitiy of crankcase vapors increases because of a negative pressure effect on the crankcase vapors in the condenser 52;

(2) as the oil mists are not condensed and separated in the rocker-arm chamber 50, it is difficult to completely remove all of the oil mist by the condenser 52;

(3) some of the oil mist in a crankcase ventilating system flows into the combustion chamber with the intake air, decreasing combustion performance and increasing white smoke in the exhasut gases causing added air pollution;

(4) in case of agglutination of the piston rings, the crankcase vapors increase rapidly, allowing some quantity of engine lubricating oil to mix in the intake air causing abnormal combustion; and, (5) in some cases, an extreme increase in the compression ration causes damage of the connecting rod.

In order to strengthen the oil separating performance of the condenser 52, the condenser 52 itself has to be enlarged and complicated, which results in the intake resistance of the air cleaner C' increasing. To improve the above defects, it is possible to dispose the condenser in the primary chamber of the air cleaner and to prevent the negative pressure to work on the condenser, whereby the processing quantity can be decreased.

However, in the above structure, residual oil mist included in the crankcase vapors coming out of the condenser sticks to cleaner elements such as filter papers, the filter papers become stopped up, the intake resistance increases, and the engine output decreases. The cleaner elements are damaged heavily by the negative pressure, and the unfiltered intake air damages the cylinders.

SUMMARY OF THE INVENTION

In order to solve the above problems, the present invention can effectively remove the oil mist in the crankcase vapors.

After separating some of the oil mist in the crankcase vapors introduced into the rocker-arm chamber through a breather device of the engine, the vapors are introduced into the primary port of an oil-bath type air cleaner, whereby the oil mist in the vapor gases can be removed completely by oil-bathing and with the cleaner elements.

The invention comprises a breather device installed on an internal combustion engine, an oil-bath type air cleaner, a vapor inlet formed on said air cleaner and a vapor passage which communicates said vapor inlet with a vapor outlet of said breather device. Said breather device for separating the oil mist in crankcase vapors communicates with the crank chamber of said engine, and the clean air outlet of said air cleaner communicates with the combustion chamber.

The vapor inlet is formed by the way of the air passage through the air inlet and the air introducing passage and the oil-bath chamber and the cleaner elements of said air cleaner.

Through the invention, the following advantages can be attained:

(1) Most of the oil mist in crankcase vapors is separated primarily with the breather device, then residual oil mist is separated with the cleaner elements of the oil-bath air cleaner.

As the oil separating performance of said air cleaner is quite high, the oil mist in the vapors can be removed completely, thus lubricating oil mist from the crank chamber never flows into the combustion chamber together with the intake air. Consequently, the combustion performance can be improved, and the exhaust gas become clean.

(2) The oil-bath chamber and the cleaner elements can be untilized effectively for separating the oil mist in the vapors, thereby special oil separating devices for the vapors can be saved. Moreover, because of the large oil separating capacity of the oil-bath type air cleaner, the breather device can be simplified so as to separate roughly the oil mist in the vapors. Therefore, this invention can be applied to practical uses easily and cheaply.

(3) The lubricating oil separated from the crankcase vapors is of the same kind as that of the air cleaner. After absorption into the oil in the oil-bath and the cleaner elements, the lubricating oil serves to clean the intake air, therefore, the cleaning performance and intake resistance of the air cleaner can be maintained without damage, and the durability of this apparatus is quite long.

BRIEF DESCRIPTION OF THE DRAWINGS

The exact nature of this invention, as well as other objects and advantages thereof, will be readily apparent from consideration of the following specification relating to the accompanying drawings, in which like reference characters designate the same or similar parts throughout the figures thereof.

FIG. 1 is an elevational front view in section of an embodiment of the apparatus;

FIG. 2, 3, 4 and 5 are an elevational front view in section showing respectively the oil-bath type air cleaner of another embodiment; and FIG. 6 is an elevational front view in section of prior art apparatus.

DESCRIPTION OF THE PREFERRED EMBODIMENTS

The most preferred embodiment of the present invention will be explained according to the figures.

As shown in FIG. 1, the four-cycle diesel engine E for driving a refrigerator (not shown) mounted on a refrigerating vehicle (not shown) comprises the crankcase 1, the cylinder block 2, the cylinder head 3 and the rocker-arm cover 4.

A breather device B is formed inside the top of said rocker arm cover 4. An oil-bath type air cleaner C is mounted on the side of said engine E, with the intake combustion air passing through the air cleaner C and flowing into the combustion chamber 7 through the intake passage 6 in the intake manifold 5 and the cylinder head 3.

The vapor in the crank chamber 8 is the mixture of the combustion gas leaked from the combustion chamber 7 and a large amount of lubricating oil mist.

Said crankcase vapors flow into the rocker-arm chamber 14 through the oil flow-back passage 9, cam chamber 10, the passage 11 between the tappets 12 and the push-rod passage 13, then flows into the breather device B together with lubricating oil mist generated in the rocker-arm chamber 14.

Some of the lubricating oil, in the vapors, sticks to the shield plate 15 and the rocker-arm cover 4, and some of the oil sticks to the filter 16 of the breather device B when flowing through the filter 16. Also, the shield plate 18, disposed in the vapor outlet 17, catches some lubricating oil.

The crankcase vapors are processed primarily with the breather device B, then processed secondarily with said oil-bath type air cleaner C.

In this air cleaner, intake combustion air supplied from the air inlet 19 is introduced into the oil-bath chamber 22 through the air inlet 19 and the air introducing passage 21 in the air introducing tube 28. The intake combustion air then flows into the clean air outlet 24, through the cleaner elements 23, and into the intake passage 6 from the clean air outlet 24.

In the oil-bath chamber 22, the intake air is cleaned by oil bathing, then the intake air is clened again through the cleaner elements 23.

Crankcase vapor inlet 25 is formed as part of the air introducing passage 21. This vapor inlet 25 is communicated with the vapor outlet 17 of the breather device B through a vapor passage 26. Thus, crankcase vapors are introduced into the air passage 20 in the air cleaner C from the breather device B.

At least the vapor inlet 25 has to be installed on the air passage 20 which comprises the air inlet 19, the air introducing passage 21, the oil-bath chamber 22 and the cleaner elements 23.

In this embodiment, said vapor inlet 25 is formed by fixing a short pipe to the air introducing tube 28 stretching out of the casing 27, and said vapor passage 26 is formed from any known material, for example steel pipes.

Crankcase vapors flowing into the air introducing passage 21 through the vapor inlet 25, are cleaned by oil bathing and the cleaner elements 23.

Some of the oil mist in crankcase vapors is absorbed in the oil of the oil-bath chamber 22. The residual oil mist in the vapors is absorbed in cleaner elements 23 as the air from passage 21 flows through them.

In the cleaner elements 23, comprising such materials as steel wool, the oil mist in the vapors stick to minute fibers of cleaner elements 23 and is absorbed into the oil sticking between the fibers.

As described above, the vapors passing into the breather device B from the crank chamber 8 are processed secondarily with the oil-bath type air cleaner C. Consequently, the oil mist in crankcase vapors is removed completely, thus lubricating oil mist does not mix with the intake combustion air flowing into the combustion chamber 7. As the lubricating oil in the oil mist is of the same kind as that of the air cleaner C, the oil separated from the crankcase vapors serves to clean the intake air.

The following descriptions relate to similar embodiments.

As shown in FIG. 2, the vapor inlet 25 is formed so as to fit within an opening in the top portion of the air inlet 19. In this construction, negative pressure does not affect the crankcase vapors.

As shown in FIG. 3, the vapor inlet 25 is formed so as to extend into the air introducing passage 21 downstream from the air inlet 19.

As shown in FIG. 4, the downstream end portion of the vapor passage 26 is introduced into the intake passage 6 by passing through the pipe wall, and consequently is disposed inside the casing 27 of the air cleaner C. The end of the vapor passage 26 is connected with the vapor inlet 25 formed on the air introducing passage 21. In this construction, as the crankcase vapors with high temperature are cooled by the intake air, condensation of oil mist is promoted.

As shown in FIG. 5, the vapor inlet 25 is formed so as to be directly connected with the oil-bath chamber 22. In this construction, the crankcase vapors are introduced directly into the oil bath and rise upwardly within the cleanser C, passing through the cleaner elements 23 before returning to passage 26.

What is claimed is:

1. In an apparatus which separates and removes oil contaminates from crankcase vapors which emanate from a crankcase of an internal combustion engine and returns said vapors to a combustion chamber of said internal combustion engine, comprising:

(a) a breather device located on said engine in fluid communication with said crankcase and exposed to said crankcase vapors and contaminants upon exit of said vapors from said engine;

(i) said breather device provided with filter elements which separate and remove a primary portion of said oil contaminants from said vapors;

(b) an oil-bath air cleaner contained within a casing and in fluid communication with said breather device; cleaner elements contained within said casing and an oil-bath chamber is provided below said cleaner elements and within said casing;

(c) pipe means provided in said casing; a first end of said pipe protruding outside of said casing for introducing outside air into said casing, and a second end of said pipe extending into said casing to a point slightly above said oil-bath chamber;

(d) a vapor inlet connected to said breather device and to said pipe means; said vapors and residual oil contaminants flow through said inlet to said oil-bath cleaner;

(i) said vapors and said residual oil contaminants mix with said outside air and are exposed to said oil-bath and said cleaner elements to remove said residual oil contaminants; and (e) outlet conduit means connected to said oil-bath cleaner and to said combustion chamber for returning the vapors, in the absence of said oil contaminants, to said combustion chamber.

2. The apparatus of claim 1 wherein a downstream end portion of said vapor inlet is connected into the casing of the air cleaner through the intake pipe and the clean air outlet at the point where said vapor passage is connected with said vapor inlet.

3. The apparatus of claim 1 wherein said breather device is located inside a top portion of a rocker arm cover and said filter element is directly open to a rocker arm chamber; said crankcase vapors pass through said rocker arm chamber, said filter element and a vapor outlet to said vapor inlet of said oil-bath cleaner.

4. The apparatus of claim 3 wherein a first shield plate is located in said rocker arm chamber upstream of said filter element; a second shield plate is located in said breather device downstream of said filter element; and, said first and second shield plates collect and remove a portion of said oil contaminants from said crankcase vapors.

* * * * *